US011445829B2

(12) United States Patent
Muller

(10) Patent No.: US 11,445,829 B2
(45) Date of Patent: Sep. 20, 2022

(54) COOLING CHAIR

(71) Applicant: Kristopher Muller, Brooksville, FL (US)

(72) Inventor: Kristopher Muller, Brooksville, FL (US)

( * ) Notice: Subject to any disclaimer, the term of this patent is extended or adjusted under 35 U.S.C. 154(b) by 355 days.

(21) Appl. No.: 16/055,209

(22) Filed: Aug. 6, 2018

(65) Prior Publication Data

US 2019/0045936 A1 Feb. 14, 2019

Related U.S. Application Data

(60) Provisional application No. 62/543,419, filed on Aug. 10, 2017.

(51) Int. Cl.

| | |
|---|---|
| ***A47C 7/74*** | (2006.01) |
| ***F25D 3/08*** | (2006.01) |
| ***A47C 4/28*** | (2006.01) |
| ***F25D 3/06*** | (2006.01) |
| ***F25D 31/00*** | (2006.01) |

(52) U.S. Cl.

CPC ..... *A47C 7/744* (2013.01); *A47C 4/286* (2013.01); *F25D 3/06* (2013.01); *F25D 31/002* (2013.01); *F25D 3/08* (2013.01); *F25D 2303/082* (2013.01); *F25D 2400/26* (2013.01)

(58) Field of Classification Search

CPC ..... A47C 7/744; A47C 7/742; A47C 7/74; A47C 4/286; A61F 2007/0054; A61F 2007/0055; A61F 2007/0056; F25D 3/06; F25D 31/002; F25D 2400/26; F25D 3/08; F25D 2303/082

See application file for complete search history.

(56) References Cited

U.S. PATENT DOCUMENTS

| | | | | |
|---|---|---|---|---|
| 5,027,453 | A * | 7/1991 | Koenig | A47C 27/085 5/679 |
| 5,411,541 | A * | 5/1995 | Bell | A61F 7/02 607/104 |
| 5,507,792 | A * | 4/1996 | Mason | A61M 5/1415 607/104 |
| 5,617,811 | A * | 4/1997 | Johnson | B60N 2/5614 440/89 C |
| 5,865,841 | A * | 2/1999 | Kolen | A61H 9/0078 607/104 |
| 6,302,094 | B1 | 10/2001 | Wehrly et al. | |
| 2010/0059199 | A1 | 3/2010 | Court | |
| 2012/0185021 | A1 * | 7/2012 | Johnson | F28F 3/12 607/104 |
| 2014/0217786 | A1 | 8/2014 | Stremmel | |
| 2015/0091339 | A1 | 4/2015 | Bomhard | |
| 2016/0325657 | A1 * | 11/2016 | Zhang | B60N 2/5685 |

OTHER PUBLICATIONS

Chamber_Definition (Year: 2020).*

* cited by examiner

*Primary Examiner* — Linda C Dvorak
*Assistant Examiner* — Nicholas S Borsch
(74) *Attorney, Agent, or Firm* — Mitchell J. Mehlman, Esq.

(57) ABSTRACT

A cooling device includes an insulated cooler for holding cold fluid and ice. The device has a chamber, a cover, and a fill and drain valve. A tube connects the valve to a pump. The pump provides cold fluid to a bladder configured to fit a chair. The bladder can include a back portion, a seat portion and an internal manifold arranged in a closed loop for optimized cooling. The bladder can be reconfigured to cool a targeted portion of a user's body such as a leg, arm, neck, or torso.

9 Claims, 3 Drawing Sheets

COOLING CHAIR

CROSS-REFERENCE TO RELATED APPLICATION

This application claims priority of U.S. Provisional Application Ser. No. 62/543,419, entitled "Cooling Device", filed Aug. 10, 2017, the disclosure of which is incorporated herein by reference in its entirety.

BACKGROUND OF THE INVENTION

The invention is directed to a cooling device, in particular, a device used to provide a heat transfer fluid, such as cold water from a cold source, such as a cooler, to a seat pad, chair, or any shape or size cooling bladder having an internal heat transfer structure. The cooling fluid can be circulated and recycled through a manifold in a pre-determined pattern to optimize cooling for a user. The invention is advantageous in that it can utilize otherwise wasted cooling fluid, such as a cold water/ice mixture in a cooler, to keep a user cool and comfortable.

Known devices include United States Publication No. 20150091339 ("Bomhard") which discloses a liner for a car seat, stroller seat or other similar seat for a child. The liner can have cool water circulating therethrough to help keep the child cool. The liner includes a tube disposed throughout the liner that is interconnected to a cooling chamber. A pump, typically disposed in the cooling chamber, can be used to circulate the cool fluid through the tube in the liner. The chamber can be a cooler and the fluid can be ice water.

United States Publication No. 20100059199 ("Court") is directed to a combination beverage cooler and car seat cooler for simultaneously cooling food, beverages, and the like and cooling an unoccupied car seat. The combined cooler includes an insulated container having a back panel and a front panel opposite one another, a left side panel and a right side panel opposite one another and extended between the back and front panels, the back, front, left, and right panels integrally formed with a bottom panel, thereby defining an interior cavity for receipt of an at least one item to cool, and a sealable lid being sealable with the back, front, left, and right panels and connected to the rear panel and an insulated cover for thermally protecting an unoccupied car seat. The cover has a flexible thermal barrier and is attached to the insulated container to provide a combined beverage cooler and car seat cooler.

U.S. Pat. No. 6,302,094 ("Wherley") discloses a heat exchanging coil immersed in water in a heating pod heated over a fire or other heat source. Flexible tubing connected to the coil transmits heated water or other fluid under pressure from a water pump in a reservoir connected to the tubing. Loops of the tubing pass through various items used in outdoor activity including sleeping bags, tents, heaters, bowls, chairs, and even a shower. The heated water is pumped intermittently in a continuously recirculating flow through the system from the heating coil through the item(s) and back again through the heating coil. A timer connected to the pump allows flow of the heated water bolus at any desired timed interval. Alternately, cold water may be circulated through the system for cooling in conditions of extreme heat. Ice or snow or cold water may be used in the heating pod and the pump activated to circulate the chilled water.

United States Publication No. US 20140217786 ("Stremmel") discloses a seat cooling system for a vehicle seat comprising: a cooling fluid container; a mechanism to transfer cooling fluid from the cooling fluid container into a bottom portion of the seat; and a mechanism to transfer cooling fluid from the cooling fluid container into a lumbar portion of the seat. In one exemplary embodiment, the mechanism to transfer cooling fluid from the cooling fluid container into a bottom portion of the seat may include a plurality of coils. Furthermore, the mechanism to transfer cooling fluid from the cooling fluid container into a lumbar portion of the seat may also include a plurality of coils. The instant invention solves the problems and improves known devices.

None of these known devices include the features and benefits of the instant invention. Therefore, there is an unfilled need for a cooling chair/device that uses waste water for cooling a user or part of a user's body.

SUMMARY OF THE INVENTION

In one embodiment of the present invention, an insulated cooler has a chamber and a cover. The cooler includes a fill and drain valve. A first hose is connected to the fill and drain valve and to a pump. A second hose is connected to the pump and a bladder configured to fit on a chair. The bladder includes a back portion, a seat portion, and a manifold arranged in a closed loop between the cooler and said bladder. The pump provides a cold fluid from said cooler to fill the bladder thereby providing cooling to a user sitting on a chair.

In some embodiments the bladder includes a drain valve for draining the fluid after use, when the user decides the fluid is too warm or needs replenishment.

In certain embodiments, the first and second hoses and the pump are configured to supply the cold fluid either from the cooler to the bladder or from the bladder to the cooler.

In other embodiments, the first and second hoses and the pump are configured to continuously recirculate the cold fluid between the cooler and the bladder.

In particular embodiments, the manifold includes a first, a second, and a third chamber located within the back portion of the bladder or chair pad.

In other embodiments, the manifold includes a first, a second, and a third chamber located within the seat portion of the bladder.

In some other embodiments, the manifold includes a first chamber, a second chamber, and a third chamber located within the back portion and a first chamber, a second chamber, and a third chamber located within the seat portion. The chambers located in the back portion being interconnected to the chambers located in the seat portion for channeling cold fluid in an optimized path.

In a certain embodiment, the manifold includes a thermostat for monitoring a temperature of said cold fluid. The thermostat can be used to signal the pump to turn on or off to maintain a set temperature range.

In another aspect of the present invention a cooling device includes an insulated cooler having a chamber and a cover. The cooler has a fill and drain valve. A first hose connects to the fill and drain valve and to a pump. A second hose connects to the pump and a bladder configured to fit a user. The bladder includes a manifold arranged in a closed loop between the cooler and the bladder. The pump provides a cold fluid from the cooler to fill the bladder thereby providing cooling to a user.

In some embodiments the bladder includes a drain valve for draining said fluid after use.

In other embodiments the first and second hoses and the pump are configured to supply the cold fluid either from the cooler to the bladder or from the bladder to the cooler.

In particular embodiments, the first and second hoses and the pump are configured to continuously recirculate the cold fluid between the cooler and the bladder.

In some embodiments, the manifold includes at least one chamber.

In other embodiments, the manifold includes a plurality of chambers.

In some embodiments, the bladder is configured to fit on any one of a user's torso, neck, leg, arm, elbow, knee, wrist, or ankle, or other body part.

In another aspect of the invention a method of cooling a user using waste or excess water from a cooler includes: filling an insulated cooler with ice and water to form a cold fluid; connecting a hose to a fill and drain valve and to a pump; connecting the pump to a bladder having a manifold; and pumping the cold fluid into the bladder and through the manifold to fill the bladder, thereby cooling a user who comes in contact with the bladder.

In some embodiments, the bladder is configured to be a seat pad for a chair.

In other embodiments, the method can further include the step of draining the manifold by opening a drain valve located in the manifold.

In yet other embodiments, the method can further include the step of recirculating fluid between the bladder and the cooler after the cold fluid has become warm.

In some other embodiments, the method can further include the step of continuously recirculating cold fluid between the bladder and the cooler.

In one embodiment of the invention, the device can include a cooler or ice box with a one way or a two-way fluid transfer hose. The hose can be connected to a chair pad that contains a manifold having cooling channels designed for maximum heat transfer and optimum flow rate. The cold water from the cooler can be pumped through the cooling channels to cool a user sitting on the pad. In some embodiments, the pump can be a continuous flow pump to allow cold water to flow at adjustable rates throughout the pad for variable cooling.

In other embodiments, the pump can be a dual flow pump and can include a temperature sensor or a timer. In some embodiments a predetermined volume of cold water is pumped into the chair pad. When the water in the pad becomes too warm, the pump can reverse the flow of water back to the cooler or eliminate the water through a bypass valve and refill the pad with cold water generated, for example, from melting ice in a cooler. The pump can be powered by a battery or any other power source.

In some embodiments, the invention includes a chair having custom cooling seat members such as a seat pad and back member. In other embodiments, the device includes a cooling pad that can fit on a variety of existing chairs.

DESCRIPTION

Figure 1:
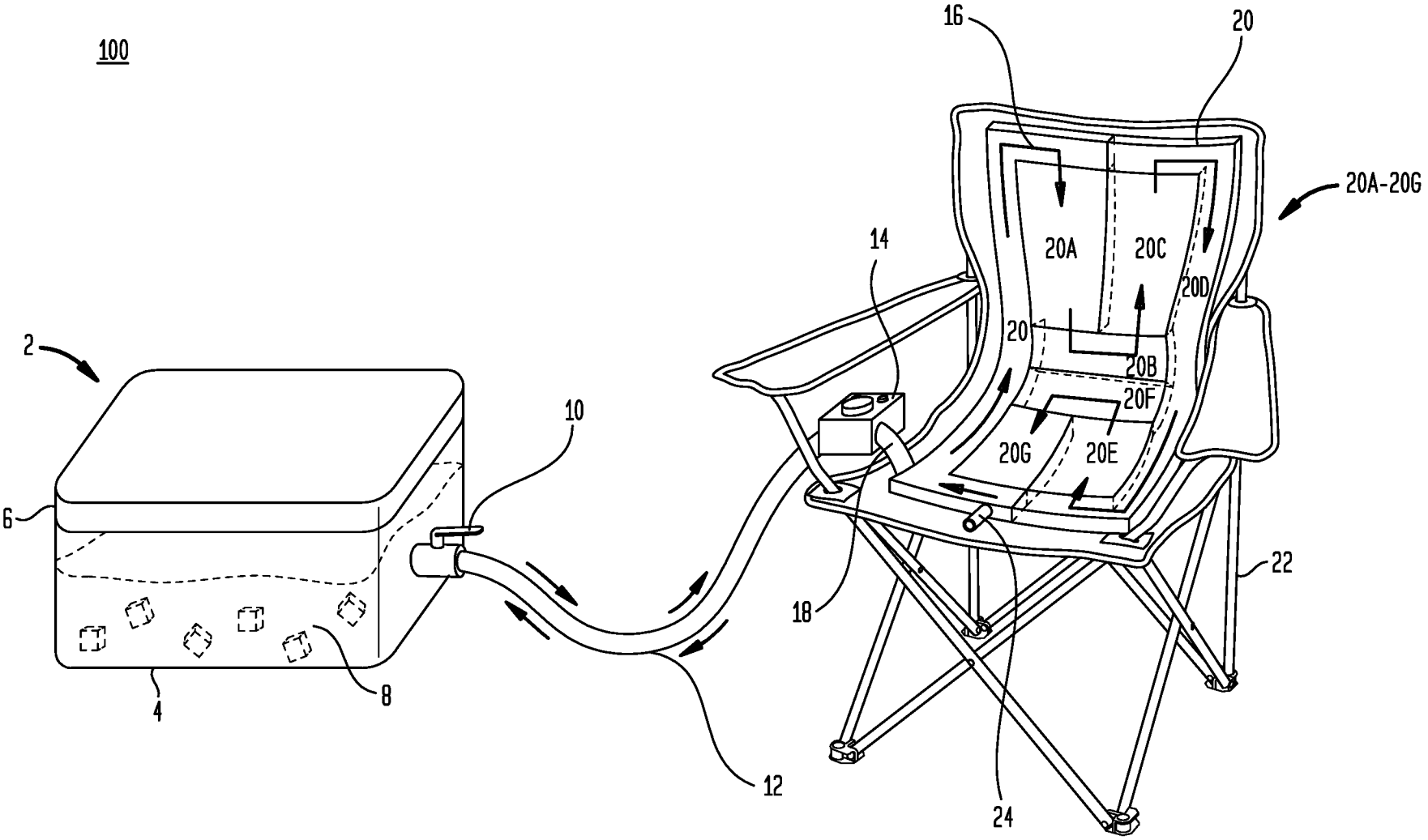
FIG. 1 depicts an isometric view of one non-limiting embodiment of some of the elements of the instant cooling device.
Figure 2:
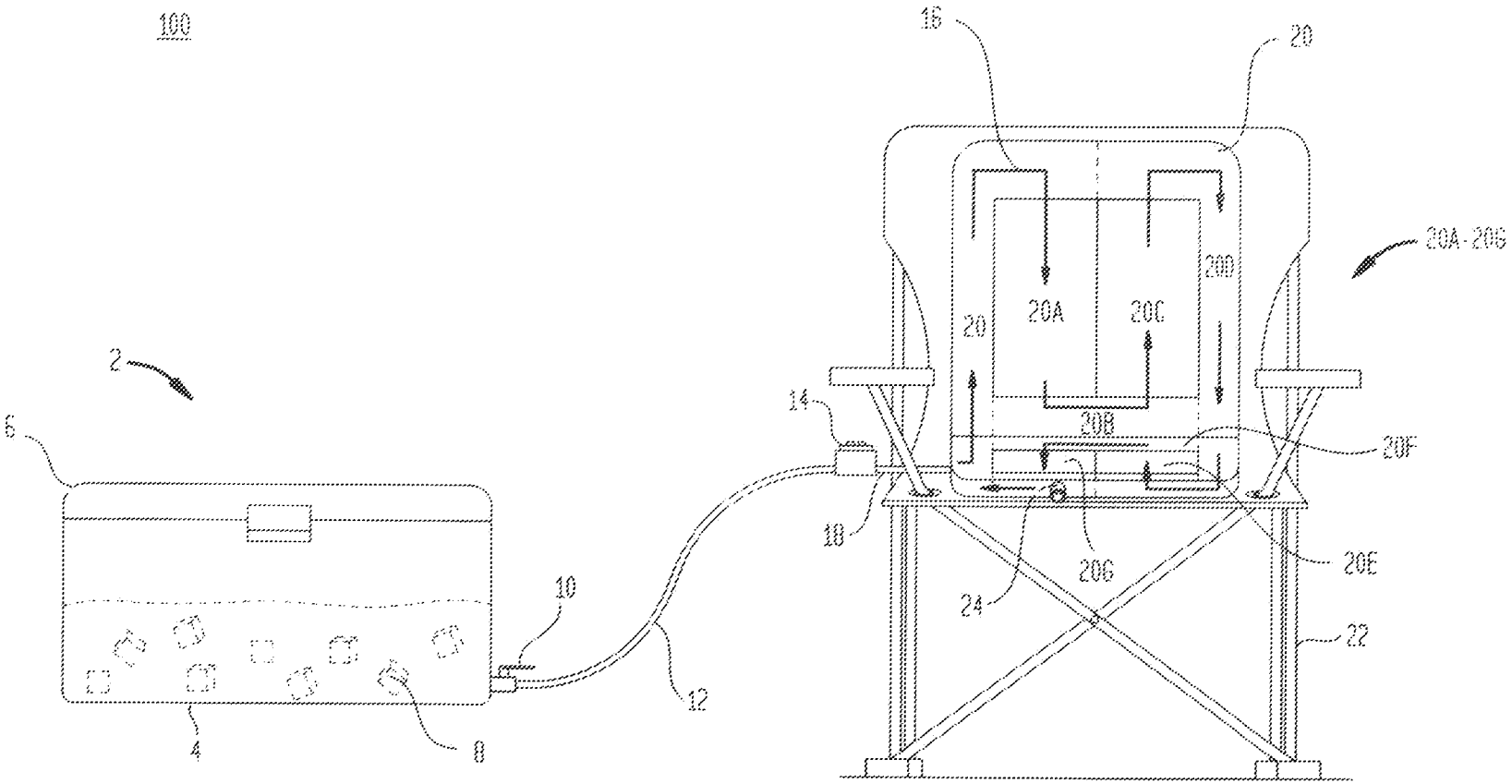
FIG. 2 depicts a front view of one non-limiting embodiment of a portion of the instant device.

FIGS. 1 and 2 depict a non-limiting embodiment of the present invention. The device 100, includes a cooler or ice box 2 having an insulated chamber 4 and cover or lid 6 for storing ice/water 8 and various sundries that require cooling. The cooler can be a Styrofoam cooler, a molded polymeric cooler, or any other water proof insulated container. The cooler 2 includes a fill and drain valve 10 for a fluid, such as ice water to flow into or out of the cooler. The valve can be opened or closed.

A hose 12 for transporting fluid can be connected to the valve 10 on one end and connected to a pump 14 on the other end. The pump can be a single direction flow pump for pumping cold water from the cooler or a dual flow pump for pumping water in either direction to recharge the device with cold water as necessary. The pump can be operated by any known power source such as a battery or a solar cell.

In some embodiments, the pump has a switch for manually turning the pump on or off. In other embodiments, the pump can be operated automatically by a thermostat in that can be set by a user to sense when the fluid is too warm or too cold in order to control the operation of the pump. When more cooling is demanded, the pump can operate continuously, when less cooling is required, the pump can operate intermittently.

In this embodiment, cold water 8 can be pumped via outlet hose 18 through chair pad bladder 20. Flow lines 16 indicated the direction of fluid flow in one particular embodiment. In this embodiment, bladder 20 include chambers 20A-20G. The cold fluid enters the bladder 20 and into chambers 20A, 20B, and 20C, respectively in the top or back portion of the bladder/pad. Fluid then exist chamber 20C and enters 20D which connects to 20E in the bottom or seat portion of the bladder. Fluid then moves through 20E-G, before returning to the entry point at the exit of hose 18. The bladder can include a drain valve 24 so that warm or used fluid can be emptied and replaced with fresh cold fluid as the user desires.

The seat pad bladder 20 can be placed on a chair 22, such as a folding portable chair. The bladder can be connected or disconnected from the chair as required by a user. In some embodiments, the bladder is an open structure that can be filled or drained. The seat pad bladder 20 can be built into the structure of a chair 22 or can be a separate pad that is placed on top of an existing chair pad and seat back in order to provide maximum contact with a user's body (See FIG. 3 for example).

The pump can be shut off leaving cold water inside the chair pad bladder. A temperature sensor can be used to determine when the water becomes too warm or the user can manually operate the pump for additional cooling. When the water becomes too warm, the water can be pumped back into the cooler through hose 12 where it can mix with cold water or ice. A fresh supply of cold water can then be pumped back into the pad. In some embodiments, once the water in the pad becomes too warm, it can be eliminated through a manual drain valve 24 and discarded.

In some embodiments of the invention, no pump is required. In this case the cooling device is operated by gravity. The cooler is placed in an elevated position which allows flow of cold water into to the bladder and, after use, allows warm water to be eliminated from the drain valve.

In other embodiments of the invention, the bladder can be shaped in a variety of useful shapes for cooling. For example, a chair seat pad, a bed pad, or a chaise lounge pad.

In some embodiments, the bladder can be fashioned into a cooling device for a specific part of the body such as, for example, a head, neck, wrist, or ankle bladder that can be wrapped around and secured to a specific part of the body with fasteners, such as hooks and loops, for maximizing contact pressure and cooling.

Figure 3:
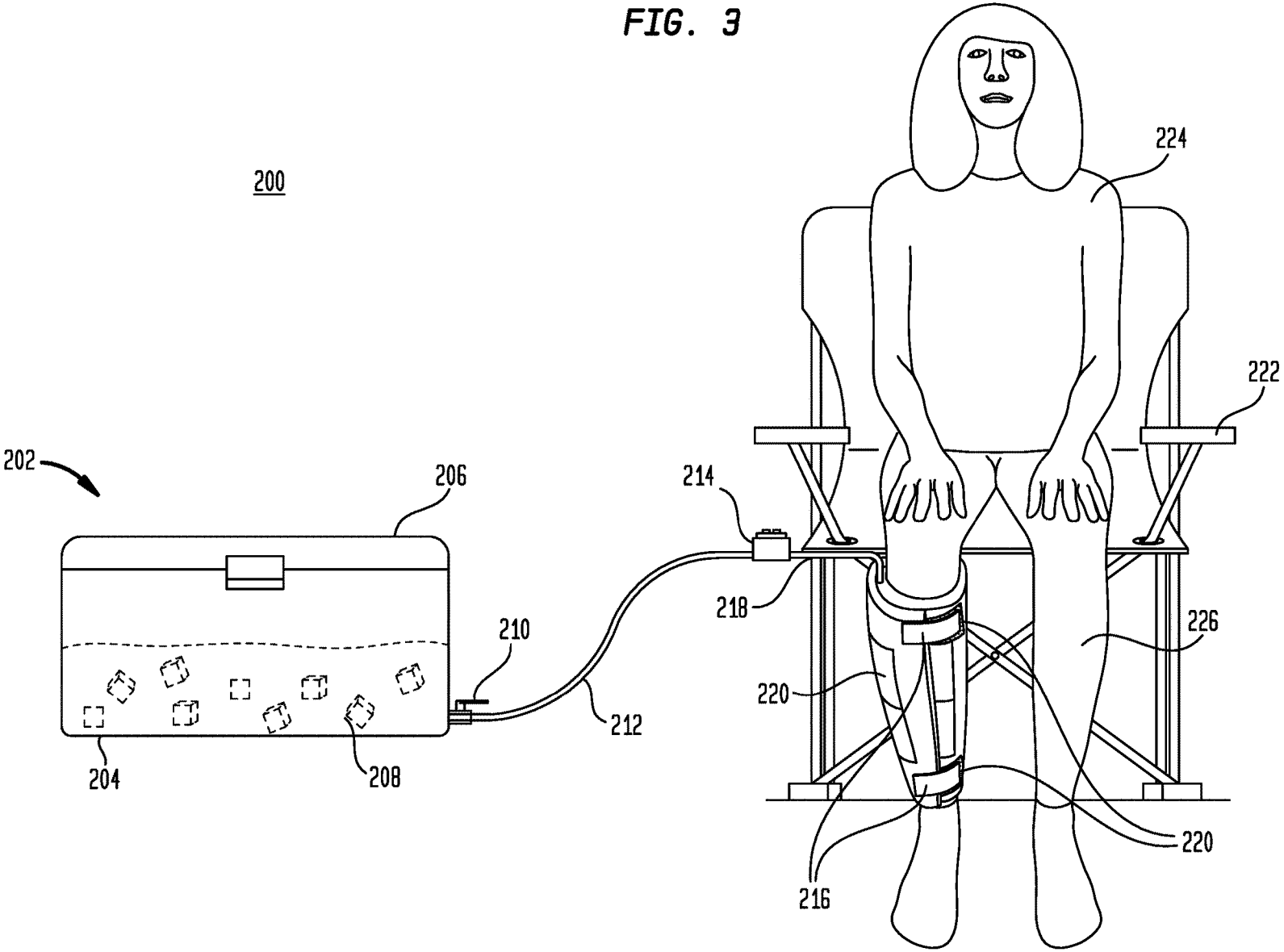
FIG. 3 depicts an isometric view of one non-limiting embodiment of the device as used for cooling a body part.

For example, FIG. 3 depicts a device 200 including for targeted cooling of a user's 224 body part, such as a leg 226. The device includes a cooler 202 having a chamber 204, and a lid 206 for insulating cold water and ice 208. Fill and drain valve 210 is connected to a hose 212. The hose connects to pump 214 which connects on the outputs side via hose 218 to cooling bladder 216. In this embodiment, the bladder 216 can include the same features as the bladder shown in FIGS. 1 and 2, including the flow chambers 220 and a drain valve (not shown). The bladder can be configured to be used as a seat pad in a chair (See FIGS. 1-2) and then removed from the chair 222 and reconfigured to be used as a leg cooling device for the user 224. The bladder can be wrapped around the user's leg 226, and secured with hook and loop fasteners 220 or any known fastening means.

The bladder can include a variety of configurations for efficiently cooling the user or a part of the user's body. For example, a radiator type chair pad bladder can include parallel tubes. The cold fluid flows down the length on one tube and back down the length of the next adjacent tube, then down the length of the next adjacent tube, etc. thus maximizing cooling of the user.

Alternatively, cold fluid can be pumped through a first manifold then down a length of parallel tubes or chambers connected to the entry side of the first manifold to a second manifold connected to the exit side of the tubes or chambers for certain applications.

In some configurations a single direction flow pump is used. The cooling fluid is drained and discarded before refilling with cold fluid, while other configurations include a dual direction or recirculation pump so the fluid in the bladder is returned to the cooler and mixed with the cold fluid before recharging the manifold. A constant recirculation configuration can be used where the fluid is constantly pumped from the cooler to the manifold and returned through a two-way hose or a separate return line.

One or more pumps may be utilized. The pumps can be operated by battery, solar power, or any other known power source. The pump can be a powered pump or a manually operated pump. For example, a siphon can be used or a bulb type pump that the user operates by hand or by foot to fill the bladder with water, empty the water, or recirculate the water. Any known pump means is contemplated.

The device may include a thermostat for sensing and controlling the temperature and causing the pump to active upon a cooling demand or deactivate when no cooling demand is present.

Although the invention herein has been described with reference to particular embodiments, it is to be understood that these embodiments are merely illustrative embodiments and that other arrangements may be devised without departing from the spirit and scope of the present invention as defined by the disclosure herein.

What is claimed is:

1. A cooling device comprising:

an insulated cooler including a fluid reservoir and a cover, said cooler containing a fluid including water or a water-ice mixture, said cooler having an integral fill and drain valve, said fill and drain valve including a handle for opening or closing said fill and drain valve;

a first hose and a second hose, said first hose being connected to said fill and drain valve and to a reversible pump; said second hose being connected to said reversible pump and a bladder, said reversible pump having a first fill mode and a second drain mode, said first and second hose forming a reversible one-way fill or drain fluid path between said insulated cooler and said bladder depending on said mode of said reversible pump;

said bladder including a back portion and a contiguous seat portion configured to fit a chair, said bladder including an internal manifold comprising a plurality of substantially rectangular interconnected chambers arranged in a unidirectional countercurrent arrangement between said cooler and said bladder, said manifold including a first peripheral rectangular chamber configured to channel the fluid from said seat portion to said back portion, said back portion including a first and a second rectangular longitudinal chamber connected by a first rectangular transverse chamber, said second rectangular longitudinal chamber being connected to a second peripheral rectangular chamber configured to channel the fluid from said back portion to said seat portion, said seat portion including a third and a forth longitudinal rectangular chamber connected by a second rectangular transverse chamber, said forth rectangular longitudinal chamber being connected to said first rectangular peripheral chamber, wherein said pump provides the fluid from said cooler to fill and or drain said bladder according to the unidirectional countercurrent arrangement of the plurality of chambers thereby providing efficient cooling to a user sitting in said chair.

2. The device of claim 1, wherein said bladder includes an integral drain valve for draining said fluid after use.

3. The device of claim 1, wherein said first and second hoses and said pump are configured to cyclically fill and drain said fluid between said cooler and said bladder.

4. The device of claim 1, wherein said manifold includes a thermostat for monitoring a temperature of said fluid.

5. A method of using a cooling device comprising the steps of:

filling an insulated cooler with water, ice, or a water-ice mixture to form a fluid, said insulated cooler having a fluid reservoir, a cover and an integral fill and drain valve, said fill and drain valve including a handle for opening or closing said fill and drain valve;

connecting a first hose to said fill and drain valve and to a reversible pump;

connecting a second hose to said reversible pump and to a bladder, said reversible pump having a first fill mode and a second drain mode, said first and second hose forming a reversible one-way fill or drain fluid path between said insulated cooler and said bladder depending on said mode of said reversible pump said bladder including a back portion and a contiguous seat portion, said bladder including an internal manifold comprising a plurality of substantially rectangular interconnected chambers arranged in a unidirectional countercurrent arrangement between said cooler and said bladder, said manifold including a first peripheral rectangular chamber configured to channel the fluid from said seat portion to said back portion, said back portion including a first and a second rectangular longitudinal chamber connected by a first rectangular transverse chamber, said second rectangular longitudinal chamber being connected to a second rectangular peripheral chamber configured to channel the fluid from said back portion to said seat portion, said seat portion including a third and a forth rectangular longitudinal chamber connected by a second rectangular transverse chamber, said forth rectangular longitudinal chamber being connected to said first rectangular peripheral chamber; and circulating the fluid from said cooler to fill and flow through said bladder according to the unidirectional countercurrent arrangement of the plurality of rectangular chambers thereby providing efficient cooling to a user sitting in said chair.

6. The method of claim 5, wherein said bladder is configured to be a seat pad and a back pad for a chair.

7. The method of claim 5, further including the step of draining said manifold by opening a manifold drain valve.

8. The method of claim 5, further including the step of periodically recirculating said fluid between said bladder and said cooler when said fluid is within a specified temperature range.

9. The method of claim 5, further including the step of cyclically recirculating said fluid between said bladder and said cooler.

* * * * *